US006995714B2

(12) United States Patent
Sim et al.

(10) Patent No.: US 6,995,714 B2
(45) Date of Patent: Feb. 7, 2006

(54) INTERNAL TRIPLE-BAND ANTENNA

(75) Inventors: Dong-Uk Sim, Daejeon (KR); Seong-Ook Park, Daejeon (KR)

(73) Assignee: Information and Communications University Educational Foundation, Seoul (KR)

( * ) Notice: Subject to any disclaimer, the term of this patent is extended or adjusted under 35 U.S.C. 154(b) by 0 days.

(21) Appl. No.: 10/498,014

(22) PCT Filed: Nov. 14, 2003

(86) PCT No.: PCT/KR03/02450

§ 371 (c)(1),
(2), (4) Date: Jun. 16, 2004

(87) PCT Pub. No.: WO2005/006490

PCT Pub. Date: Jan. 20, 2005

(65) Prior Publication Data

US 2005/0122267 A1 Jun. 9, 2005

(30) Foreign Application Priority Data

Jul. 15, 2003 (KR) ..... 10-2003-0048177

(51) Int. Cl.
*H01Q 1/24* (2006.01)

(52) U.S. Cl. ..... 343/702; 343/895

(58) Field of Classification Search ..... 343/700 MS, 343/702, 895, 718, 725, 843
See application file for complete search history.

(56) References Cited

U.S. PATENT DOCUMENTS 6,320,545 B1 11/2001 Nagumo et al. ..... 343/700 MS
6,452,551 B1 * 9/2002 Chen ..... 343/702
6,842,143 B2 * 1/2005 Otaka et al. ..... 343/700 MS
2001/0011964 A1 8/2001 Sadler et al. ..... 343/824
2002/0075190 A1 6/2002 Ghosh et al. ..... 343/702
2003/0080905 A1 5/2003 Lin et al. ..... 343/702
2003/0103007 A1 6/2003 Chiu et al. ..... 343/702
2004/0001031 A1 * 1/2004 Sugimoto et al. ..... 343/895

FOREIGN PATENT DOCUMENTS

EP 1198027 A1 4/2002
EP 1221735 A1 7/2002
WO 2001/011721 A1 2/2001

OTHER PUBLICATIONS

Gwo-Yun Lee et al., "Very-low Profile Bent Planar Monopole Antenna for GSM/DCS Dual-band Mobile Phone", Microwave and Optical Technology Letters, vol. 34, No. 6, Sep. 20, 2002, pp. 406-409.

* cited by examiner

*Primary Examiner*—Wilson Lee
*Assistant Examiner*—Ephrem Alemu
(74) *Attorney, Agent, or Firm*—Bacon & Thomas, PLLC

(57) ABSTRACT

An internal antenna for use in a mobile handset is formed of a single conductive plate. The internal antenna includes a first meander-shaped portion having one or more slots, including a first bent portion bent downward at a side edge of the first meander-shaped portion; a second meander-shaped portion having one or more slots, including a second bent portion bent downward at an end of the second meander-shaped portion; and a common portion physically connected to the first and the second meander-shaped portion. The first meander-shaped portion together with the common portion forms a first radiating element and the second meander-shaped portion together with the common portion forms a second radiating element, the first radiating element having a first resonant frequency and the second radiating element having a second resonant frequency.

11 Claims, 6 Drawing Sheets

INTERNAL TRIPLE-BAND ANTENNA

RELATED APPLICATION

This application claims priority of Republic of Korea patent Application No. 10-2002-0048177 filed on Jul. 15, 2003.

1. Field of the Invention

The present invention relates to an internal antenna; and, more particularly, to an internal triple-band antenna for use in a mobile handset.

2. Background of the Invention

As is well known, an antenna is an essential part of a mobile handset. In a mobile handset, external antennas such as a helical antenna and a monopole antenna have been widely used. The monopole antenna, having an omni-directional radiation pattern and achieving a high gain, is widely used as a retractable antenna in a mobile handset. However, since extended outward, the external antennas are easily damaged by an external force to result in a characteristic deterioration.

To overcome the above-mentioned drawback of the external antennas, internal antennas such as a microstrip patch antenna and a planar inverted F antenna have been developed. However, a broadband characteristic for covering, e.g., a PCS, an IMT-2000 and a Bluetooth band is difficult to achieve by using the microstrip patch antenna or the planar inverted F antenna of a suitably small size for a mobile handset. Further, the planar inverted F antenna requires an additional element such as a shorting pin in order to be fed in a mobile handset, which raises its manufacture cost.

SUMMARY OF THE INVENTION

It is, therefore, an object of the present invention to provide an internal antenna of a single body that can implement a broadband characteristic for covering, e.g., a PCS, an IMT-2000 and a Bluetooth band in a mobile handset and can be fed via a microstrip line thereby requiring no additional element for feeding in a mobile handset to reduce a cost of manufacture.

In accordance with the invention, there is provided an internal antenna formed of a single conductive plate for use in a mobile handset, including:

a first meander-shaped portion having one or more slots, including a first bent portion bent downward at a side edge of the first meander-shaped portion;

a second meander-shaped portion having one or more slots, including a second bent portion bent downward at an end of the second meander-shaped portion; and a common portion physically connected to the first and the second meander-shaped portion, wherein the first meander-shaped portion together with the common portion forms a first radiating element and the second meander-shaped portion together with the common portion forms a second radiating element, the first radiating element having a first resonant frequency and the second radiating element having a second resonant frequency.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

Hereinafter, a preferred embodiment of the present invention will be described in detail with reference to the accompanying drawings.

Figure 1:
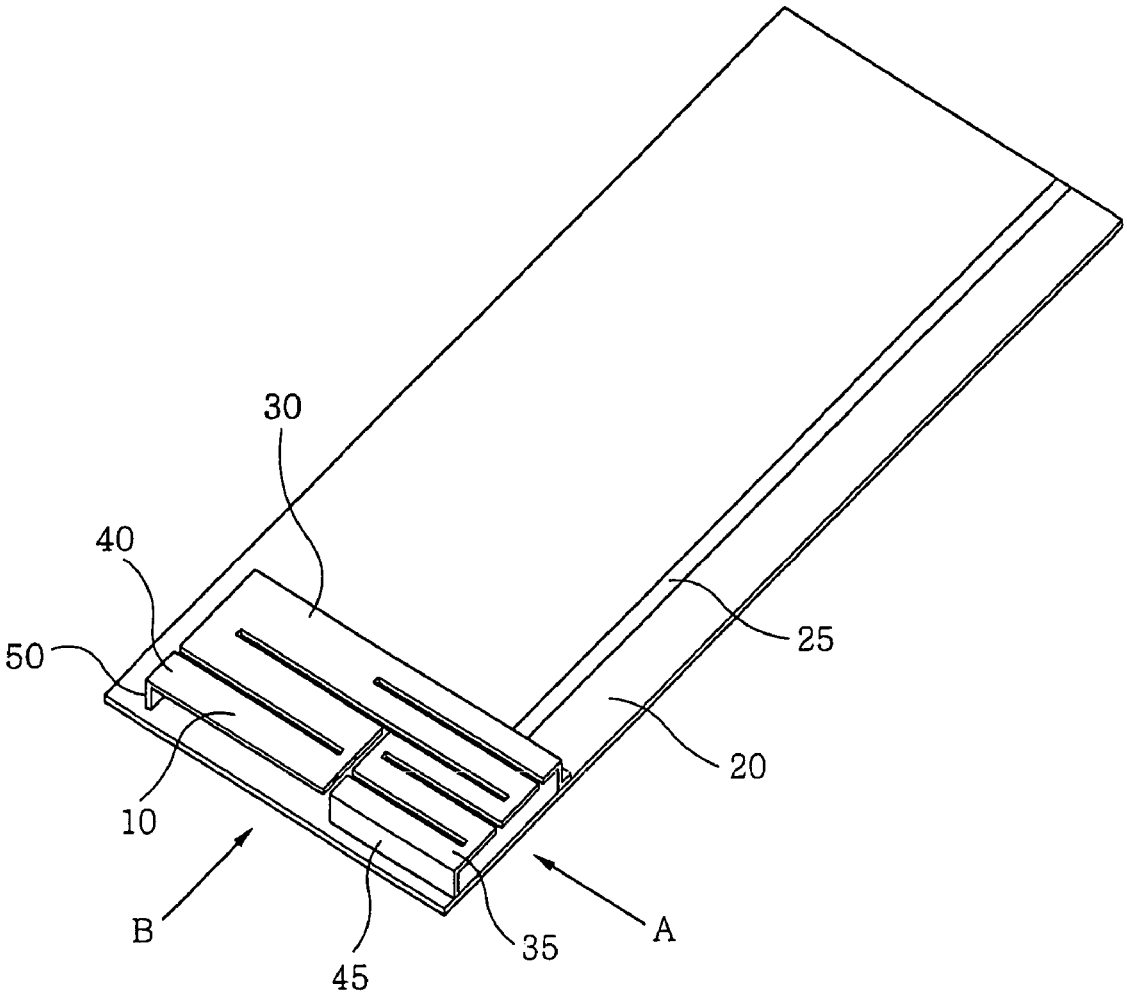
FIG. 1 shows a perspective view of a printed circuit board (PCB) for use in a mobile handset, on which an internal triple-band antenna is disposed, in accordance with a preferred embodiment of the present invention.

FIG. 1 shows a perspective view of a printed circuit board (PCB) 20 for use in a mobile handset, on which an internal triple-band antenna 10 is disposed, in accordance with a preferred embodiment of the present invention.

Referring to FIG. 1, the internal triple-band antenna 10, fed via a microstrip line 25 on the printed circuit board 20, is a single conductive plate including a common portion 30, a first meander-shaped portion 35 and a second meander-shaped portion 40. Among the common portion 30, the first meander-shaped portion 35 and the second meander-shaped portion 40 is located a T-shaped slot. The first and the second meander-shaped portion 35 and 40 have one or more linear slots, respectively, and the common portion 30 may also have a linear slot.

The first meander-shaped portion 35 together with the common portion 30 forms a first radiating element, whereas the second meander-shaped portion 45 together with the common portion 30 forms a second radiating element. The first and the second radiating body have a first and a second resonant frequency, respectively.

The first meander-shaped portion 35 has a first bent portion 45 at a side edge thereof. The second meander-shaped portion 40 has a second bent portion 50 at an end thereof. The first and the second bent portion 45 and 50 are bent vertically downward to support the internal triple-band antenna 10 on the printed circuit board 20 to suppress a mechanical vibration thereof. Besides, the second bent portion 50 increases the length of the second radiating element, reducing the second resonant frequency. In addition to this, the first bent portion 45 has an effect of attenuating an electromagnetic coupling between the first and the second radiating element, which improves a resonant characteristic at an intermediary frequency band between a frequency band covered by the first radiating element and another frequency band covered by the second radiating element, thereby enhancing a broadband characteristic of the internal triple-band antenna in accordance with the preferred embodiment of the present invention.

Figure 2:
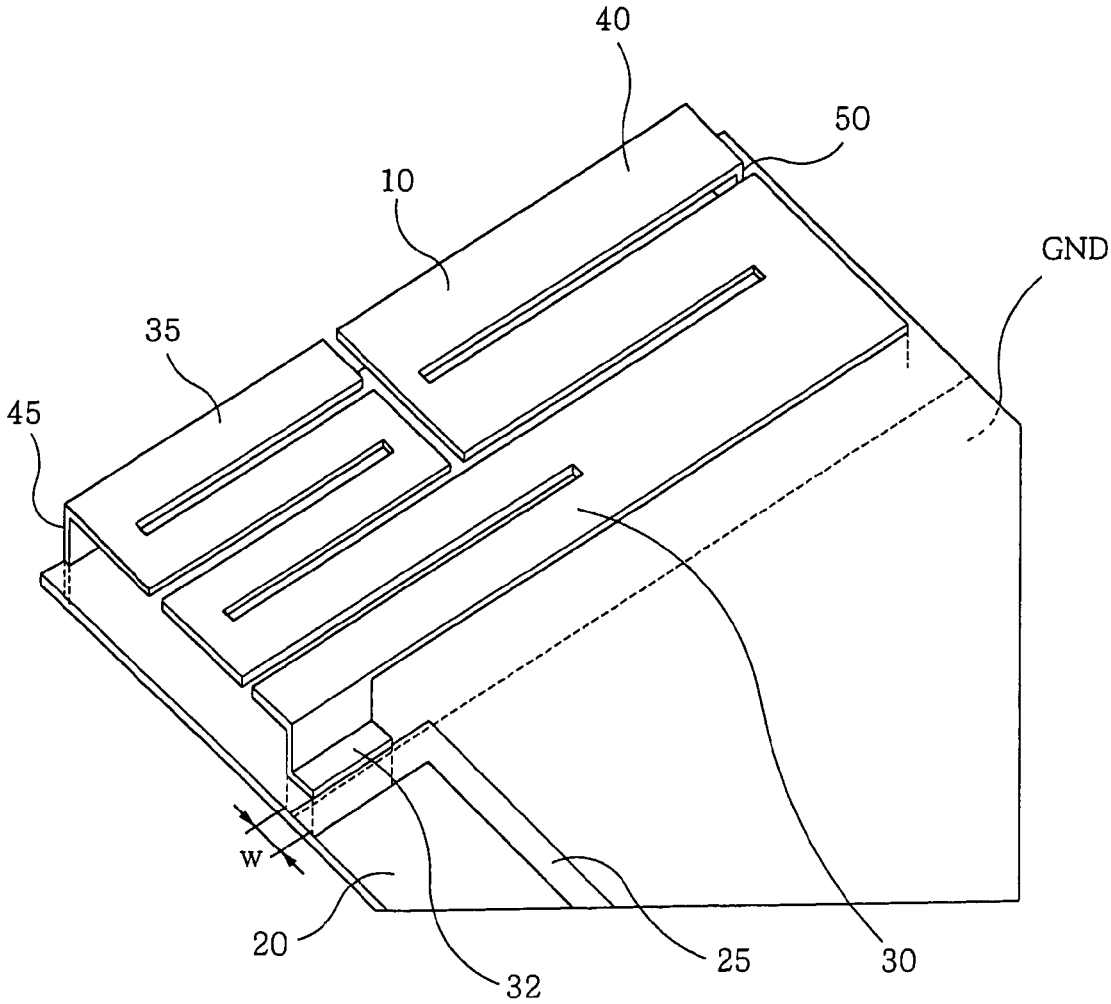
FIG. 2 illustrates an enlarged view of the triple-band antenna of FIG. 1 taken apart from the printed circuit board.

FIG. 2 illustrates an enlarged view of the triple-band antenna 10 taken apart from the printed circuit board 20. A dotted line in FIG. 2 represents a border of a grounded portion GND located beneath a certain region of the printed circuit board, the above-mentioned region of the printed circuit board including the microstrip line 25.

Referring FIG. 2, the common portion 30 is physically connected to a contact portion 32. The contact portion 32 overlaps and contacts with a feed portion of the microstrip line 25. The feed portion, at which the internal triple-band antenna 10 is fed, adjoins a side edge, e.g., a left edge of the printed circuit board 20. Preferably, the microstrip line 25 is located closer to the above-mentioned side edge, e.g., the left edge of the printed circuit board than the opposite side edge, e.g., a right edge in accordance with a conventional location of a feeding portion in a mobile handset, e.g., a cell phone.

The microstrip line 25 is deflected in a direction, e.g., perpendicular to the microstrip line 25 near at the feed portion. This may cause a power loss due to a radiation at the deflected portion. To reduce the power loss and obtain a good 50 Ω transmission line, an impedance matching at a given resonance frequency can be achieved by adjusting a width of the microstrip line 25 at the deflected portion, designated by W.

Figure 3:
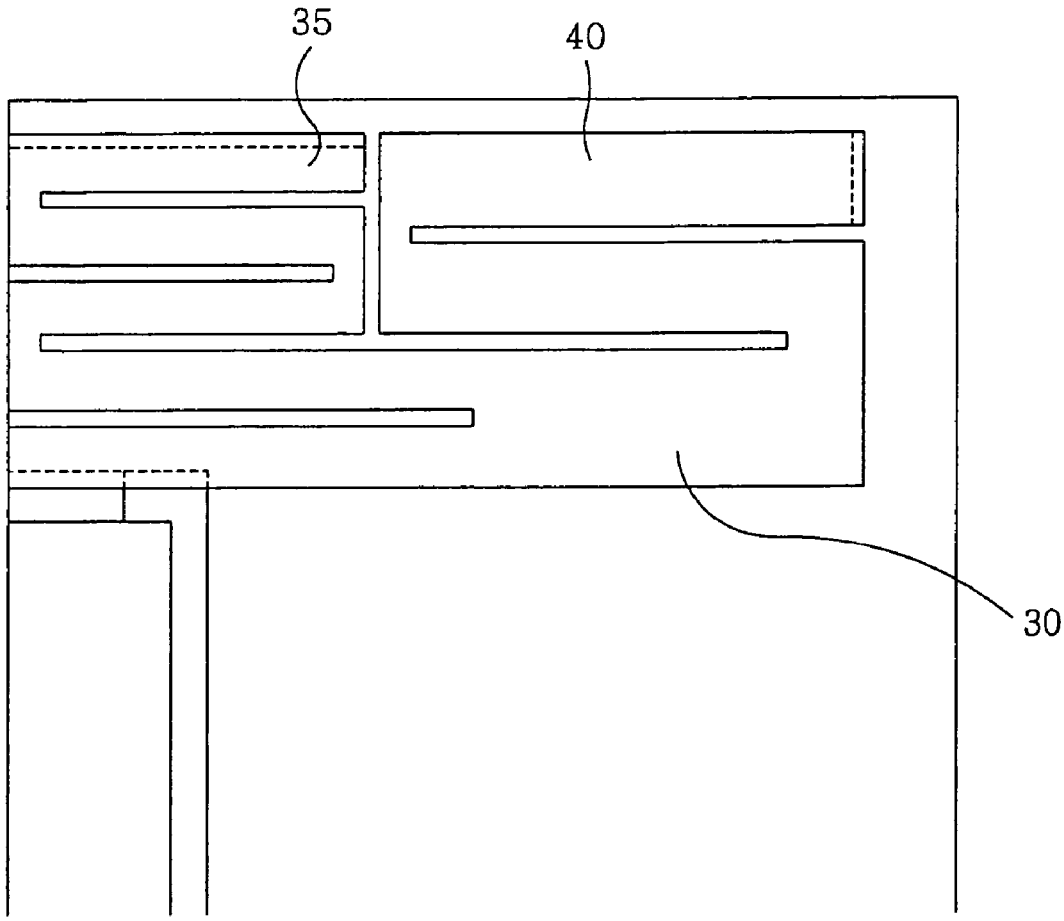
FIG. 3 describes a plain view of the internal triple-band antenna of FIG. 1.

FIG. 3 describes a plain view of the internal triple-band antenna 10.

Referring to FIG. 3, the first meander-shaped portion 35 has more changes of direction than the second meander-shaped portion 40. By this, the first radiating element, i.e., the first meander-shaped portion 35 together with the common portion 30 has a greater length than the second radiating element, i.e., the second meander-shaped portion 40 together with the common portion 30, which means that the first resonant frequency, i.e., the resonant frequency of the first radiating element, is smaller than the second resonant frequency, i.e., the resonant frequency of the second radiating element.

Preferably, the first resonant frequency covers a Bluetooth band and the second resonant frequency covers a PCS and an IMT-2000 band. By modifying a geometry of the meander-shaped portion 35 or 40, i.e., by changing the number, positions or lengths of the linear slots thereof, the corresponding resonant frequency can be changed. In this manner, a desired broadband characteristic can be obtained.

Figure 4:
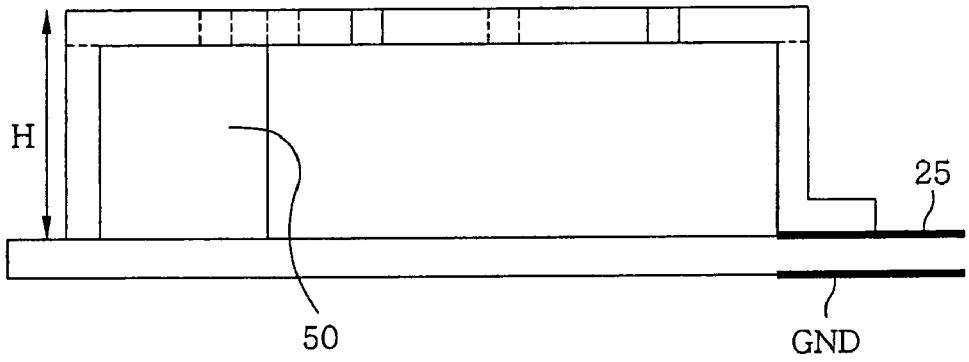
FIG. 4 offers a side view of the internal triple-band antenna of FIG. 1 as viewed in a direction indicated by an arrow A in FIG. 1.
Figure 5:
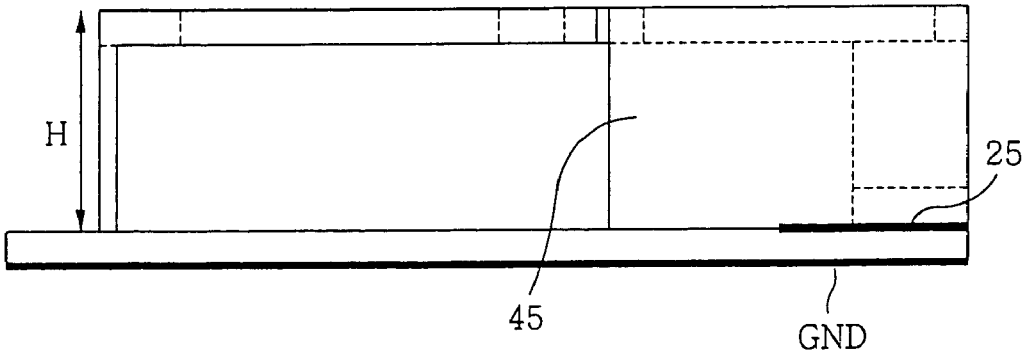
FIG. 5 presents a side view of the internal triple-band antenna of FIG. 1 as viewed in a direction indicated by an arrow B in FIG. 1.

FIGS. 4 and 5 offer side views of the internal triple-band antenna of FIG. 1 as viewed in a direction indicated by an arrow A and an arrow B in FIG. 1, respectively.

Referring to FIGS. 4 and 5, a height of the end portion 45 or 50, designated by H, determines a height of the internal triple-band antenna 10 with respect to the printed circuit board 20. A variation of the height H has an influence on a performance characteristic of the internal triple-band antenna 10. Preferably, the height of the internal triple-band antenna 10 is about 4 mm or less, being less than that of a conventional planar inverted F antenna. Preferably, the internal triple-band antenna 10 has a dimension of $27\times12.5\times3.5$ mm$^3$, being smaller than a conventional planar inverted F antenna.

Figure 6:
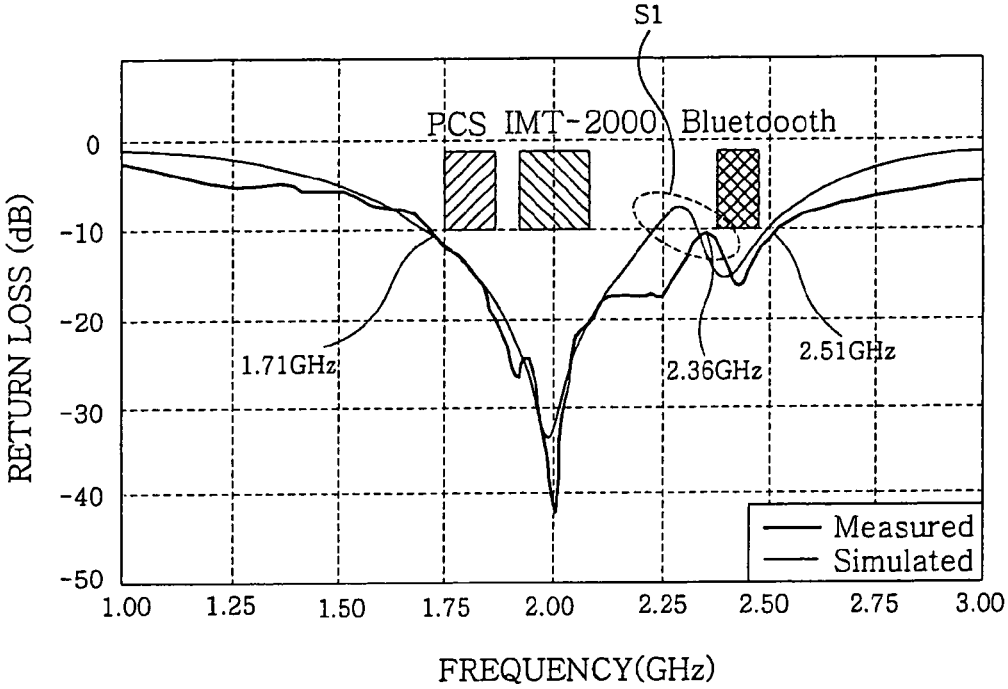
FIG. 6 depicts a measured return loss and a simulated return loss of the internal triple-band antenna in accordance with the preferred embodiment of the present invention as functions of a frequency.

FIG. 6 depicts a measured return loss and a simulated return loss of the internal triple-band antenna in accordance with the preferred embodiment of the present invention as functions of a frequency.

Referring to FIG. 6, the first radiating element covers the PCS band (about 1750 to 1870 MHz) and the IMT-2000 band (about 1920 to 2170 MHz) whereas the second radiating element covers the Bluetooth band (about 2402 to 2483.5 MHz). As one can be seen in this result, the internal triple-band antenna in accordance with the preferred embodiment of the present invention achieves a broadband characteristic. Moreover, The resonant characteristic of the internal triple-band antenna in accordance with the preferred embodiment of the present invention is improved at the above-mentioned intermediary frequency band, designated by S1.

Figure 7:
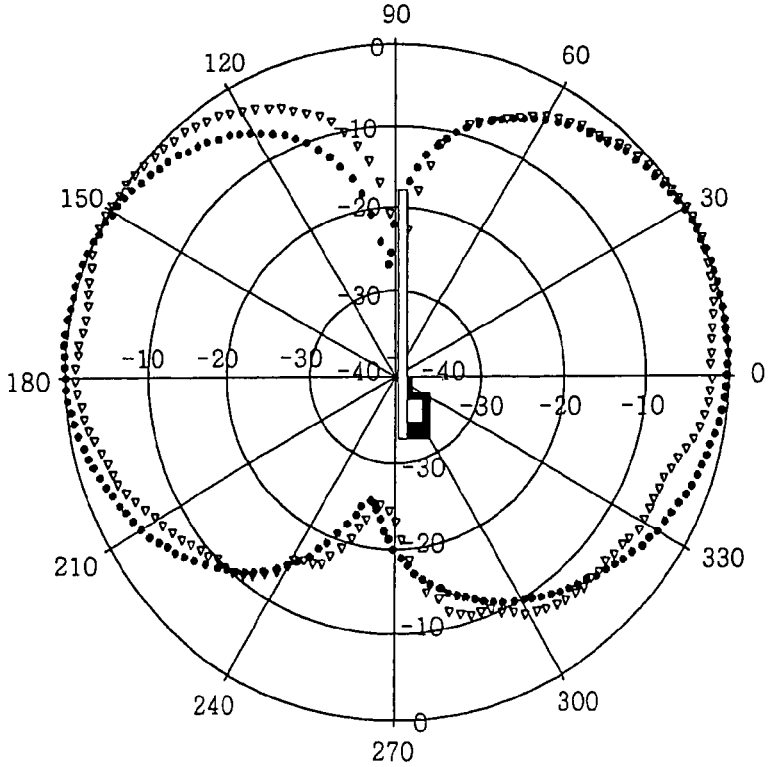
FIGS. 7 to 9 illustrate measured radiation patterns and simulated radiation patterns of the internal triple-band antenna in accordance with the preferred embodiment of the present invention at a frequency of 2 GHz.
Figure 8:
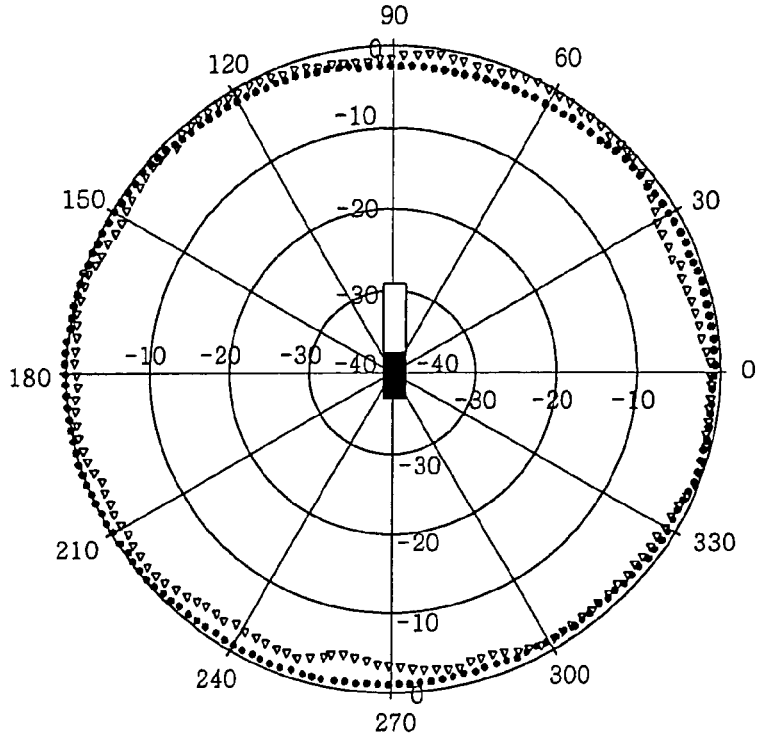
Figure 9:
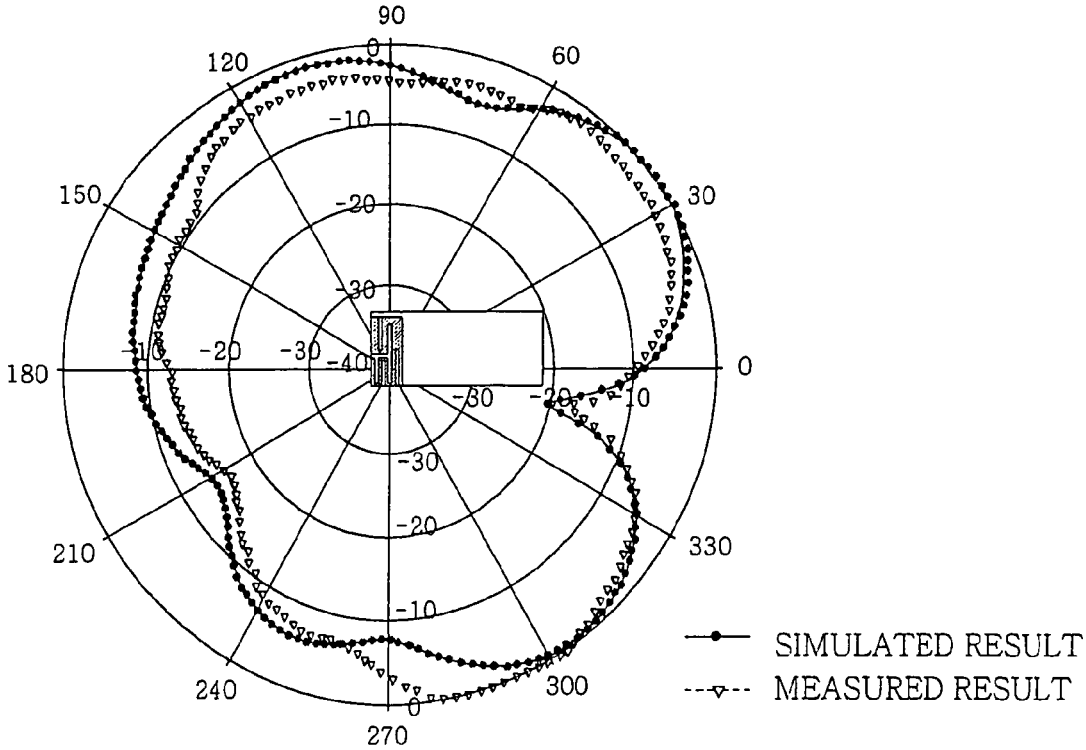

FIGS. 7 to 9 illustrate measured radiation patterns and simulated radiation patterns of the internal triple-band antenna in accordance with the preferred embodiment of the present invention at a frequency of 2 GHz.

Referring to FIG. 7 to 9, the measured and simulated radiation patterns are omni-directional in a same manner as a typical monopole antenna. A maximum radiation gain of the internal triple-band antenna in accordance with the preferred embodiment of the present invention at a frequency of 2 GHz equals to 2.7 dBi.

As described above, the present invention provides a single-body internal antenna including a plurality of meander-shaped portions that can implement a broadband characteristic for covering a PCS, an IMT-2000 and a Bluetooth band in a mobile handset and can be fed via a microstrip line. A desired broadband characteristic can be obtained by modifying the geometry of each meander-shaped portion.

It is to be readily appreciated by those skilled in the art that such variations can be easily accommodated by simple modifications of the preferred embodiments of the present invention, e.g., by modifying a geometry of the antenna of the preferred embodiments of the present invention to be suitable for covering more than three frequency bands.

While the invention has been shown and described with respect to the preferred embodiments, it will be understood by those skilled in the art that various changes and modifications may be made without departing from the spirit and scope of the invention as defined in the following claims.

What is claimed is:

1. An internal antenna formed of a single conductive plate for use in a mobile handset, comprising:

a first meander-shaped portion having one or more slots, including a first bent portion bent downward at a side edge of the first meander-shaped portion;

a second meander-shaped portion having one or more slots, including a second bent portion bent downward at an end of the second meander-shaped portion; and a common portion physically connected to the first and the second meander-shaped portion, wherein the first meander-shaped portion together with the common portion forms a first radiating element and the second meander-shaped portion together with the common portion forms a second radiating element, the first radiating element having a first resonant frequency and the second radiating element having a second resonant frequency.

2. The internal antenna of claim 1, wherein the internal antenna is fed via a microstrip line.

3. The internal antenna of claim 2, wherein the microstrip line is located on a printed circuit board.

4. The internal antenna of claim 3, wherein the first and the second bent portion support the internal antenna on the printed circuit board.

5. The internal antenna of claim 3, wherein the first resonant frequency covers a Bluetooth band and the second resonant frequency covers a PCS and an IMT-2000 band.

6. The internal antenna of claim 3, wherein a grounded portion is located beneath a region of the printed circuit board.

7. The internal antenna of claim 6, wherein the common portion is physically connected to a contact portion overlapping and contacting with a feed portion of the microstrip line, the internal antenna being fed at the feed portion.

8. The internal antenna of claim 7, wherein the feed portion adjoins a side edge of the printed circuit board.

9. The internal antenna of claim 8, wherein the microstrip line is closer to the side edge of the printed circuit board than the opposite side edge of the printed circuit board.

10. The internal antenna of claim 7, wherein the microstrip line is deflected squarely near at the feed portion.

11. The internal antenna of claim 3, wherein a height of the internal antenna with respect to the printed circuit board is 4 mm or less.

* * * * *